United States Patent [19]

Stahlecker

[11] Patent Number: 4,519,196

[45] Date of Patent: May 28, 1985

[54] WRAPPED YARN SPINNING MACHINE WITH SEVERAL SPINNING PLACES

[75] Inventor: Fritz Stahlecker, Bad Ueberkingen, Fed. Rep. of Germany

[73] Assignee: Hans Stahlecker, Sussen, Fed. Rep. of Germany; a part interest

[21] Appl. No.: 426,931

[22] Filed: Sep. 29, 1982

[30] Foreign Application Priority Data

Oct. 3, 1981 [DE] Fed. Rep. of Germany ..... 3139394

[51] Int. Cl.[3] ..... D02G 3/36; D01H 13/16

[52] U.S. Cl. ..... 57/18; 57/17; 57/19; 57/80

[58] Field of Search ..... 57/16–19, 57/80, 81

[56] References Cited

U.S. PATENT DOCUMENTS 3,177,642 4/1965 Korikovsky ..... 57/18
3,478,506 11/1969 Kawashima ..... 57/18 X
3,681,909 8/1972 Korikovsky et al. ..... 57/18 X
4,117,654 10/1978 Petrov et al. ..... 57/19
4,389,837 6/1983 Stahlecker et al. ..... 57/19 X

*Primary Examiner*—John Petrakes
*Attorney, Agent, or Firm*—Craig & Burns

[57] ABSTRACT

A wrapped-yarn spinning machine having several spinning places which include each a hollow spindle connected with a drive and carrying a binding thread rotating therewith; the hollow spindle is provided with a false twist device and is arranged between a delivery device for a sliver to be wrapped by spinning and a take-off device for the wrapped yarn; a yarn detector is coordinated to the wrapped yarn which detects the yarn tension and is operable to individually shut down the respective spinning place by interrupting the sliver feed and the drive of the hollow spindle in case of a breakage of the binding thread or of the sliver; the false twist device is provided at the inlet end of the hollow spindle while the yarn detector is arranged between the hollow spindle and the take-off device.

12 Claims, 10 Drawing Figures

WRAPPED YARN SPINNING MACHINE WITH SEVERAL SPINNING PLACES

The present invention relates to a wrapped yarn spinning machine with several spinning places, which include each a hollow spindle connected to a drive and carrying a binding thread rotating in unison therewith, the hollow spindle being provided with a false twist device and being arranged between a delivery or feed device for at least one sliver to be wrapped by spinning and a take-off device for the wrapped yarn, to which is coordinated a yarn detector detecting the yarn tension, by means of which the respective spinning place is adapted to be individually shut down by interruption of the sliver feed and of the drive of the hollow spindle in case of breakage of the binding thread and/or of the sliver.

In a known construction of this type (German Offenlegungsschrift No. 27 33 010), in which an effect yarn is made from several components, in which loops project from the yarn surface, a yarn detector is provided between a take-up device and a winding device for the effect yarn, which responds to the tension of the effect yarn. Since in case of a breakage of an individual yarn component, the effect yarn itself does not break, but the yarn formation consisting of the remaining components continues to be delivered, an additional auxiliary means in the form of a small hook is provided, by means of which the yarn tension is reduced. Use is thereby made of the fact that in case of a breakage of one yarn component, loops will form which are larger than the normally resulting loops and which are seized by the small hook. As a result thereof, the winding of the effect yarn is prevented so that the yarn tension decreases and the yarn detector can respond. The known arrangement can no longer be used if a smooth yarn is made with a wrapped yarn spinning machine, from which no loops project. In this case, the spinning place would not be shut off with the prior art arrangement, in particular in case of a breakage of the binding thread.

The present invention is concerned with the task to so construct a wrapped yarn spinning machine of the aforementioned type that a simple and effective shutting off of an individual spinning location is made possible coupled with a space-saving arrangement. The underlying problems are solved according to the present invention in that the false twist device is arranged at the inlet end of the hollow spindle and in that the yarn detector is arranged between the hollow spindle and the take-off device.

The present invention thereby starts with the recognition that with the use of sliver as yarn component to be wrapped, a shutting off by means of a tension-dependent yarn detector is possible only, if the latter is arranged within an area in which the sliver is not clamped-in over a relatively large distance and also is not provided with a twist. If, for example, the yarn detector were to be arranged between a take-off device and a winding device, then in case of the absence of the binding thread, a tension reduction could occur in the remaining sliver component only if the distance between the take-off device and the winding device significantly exceeds the length of the fiber material to be spun, which, however, must lead to an unfavorable space utilization. An arrangement between the hollow spindle and the take-off device is possible in that the false twist device is installed at the inlet side of the hollow spindle since in that case the produced false twist is limited to an area lying at a significant distance to the yarn detector whereas simultaneously the sliver is not clamped-in over a length that essentially exceeds its staple length. The arrangement of the false twist device at the inlet side of the hollow spindle therebeyond offers the advantage that altogether a smaller twist distance is achieved which, however, extends up to the clamping places of the feed or delivery device. On the one hand, the yarn quality is improved therewith since possible thinned-out places in the sliver are less strongly emphasized by reason of the smaller twist distance. Therebeyond, the sliver has a higher stability within the area between the hollow spindle and the delivery device by reason of the twist so that the number of fiber breakages can be reduced.

It is known in connection with twisting machines (German Offenlegungsschrift 29 39 435) to monitor at the individual twisting places the yarn twisted together of several individual threads by means of a tension-dependent yarn detector which is arranged between the outlet end of a twisting spindle and a winding device and which monitors the overall tension of the yarn which is composed of the tensions that stem from each individual thread by reason of the thread balloon formed by the same. In case of absence of a thread and of the reduced overall tension resulting therefrom, the yarn detector is no longer held in the operating position. Such an arrangement, however, cannot be transferred to a wrapped yarn spinning machine, especially by reason of the false twist devices acting on the sliver to be wrapped. The tension differences in the overall tension are not sufficiently large in case of absence of the winding thread.

In order to prevent that the wrapped yarn is deflected so far by the effect of the yarn detector that it drags at the outlet end of the hollow spindle, provision is made in an appropriate arrangement according to the present invention that a device for limiting the deflection of the winding yarn is arranged between the hollow spindle and the yarn detector. This may be, for example, an eyelet which is arranged centrally in axial extension of the hollow spindle and which has a smaller inner diameter than the hollow spindle.

Since the tension of the wrapped yarn depends on the material feed, i.e., on the supplied sliver, it is advantageous if the yarn detector can be adjusted with respect to its response tension. In an appropriate construction of the present invention, provision is made therefor that the yarn detector is provided with a feeler which is spring-loaded by means of a spring and abuts against the yarn, whereby the tension of the spring is adjustable by means of an adjusting device.

It has been found that a particularly effective construction of the yarn detector is possible if the distance between the false twist device and the take-off rollers corresponds to at least twice the staple length of the sliver to be spun.

These and other objects, features and advantages of the present invention will become more apparent from the following description when taken in connection with the accompanying drawing which shows, for purposes of illustration only, one embodiment in accordance with the present invention, and wherein.

Figure 1:
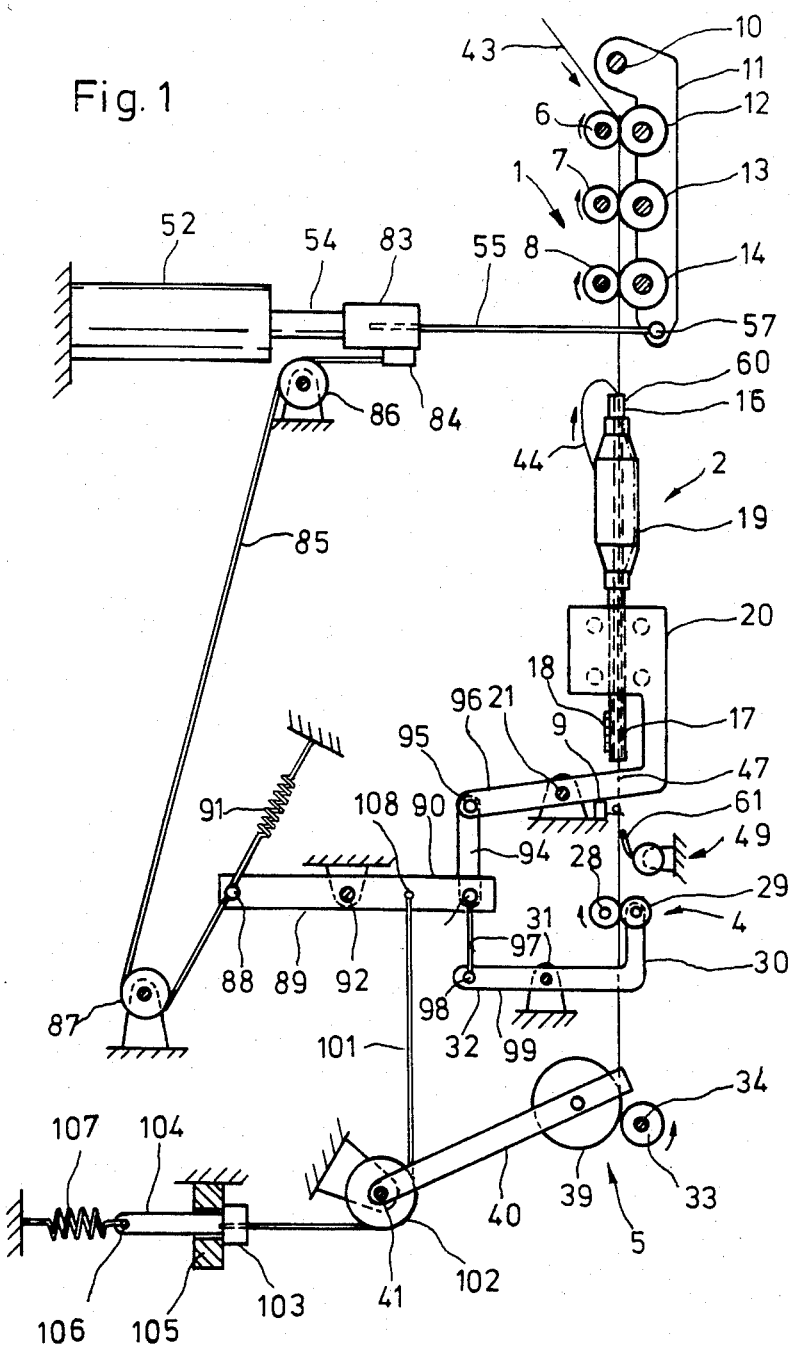
FIG. 1 is a somewhat schematic elevational view of an individual spinning place of a wrapped yarn spinning machine in accordance with the present invention, illustrating the various parts thereof in their operating position.
Figure 2:
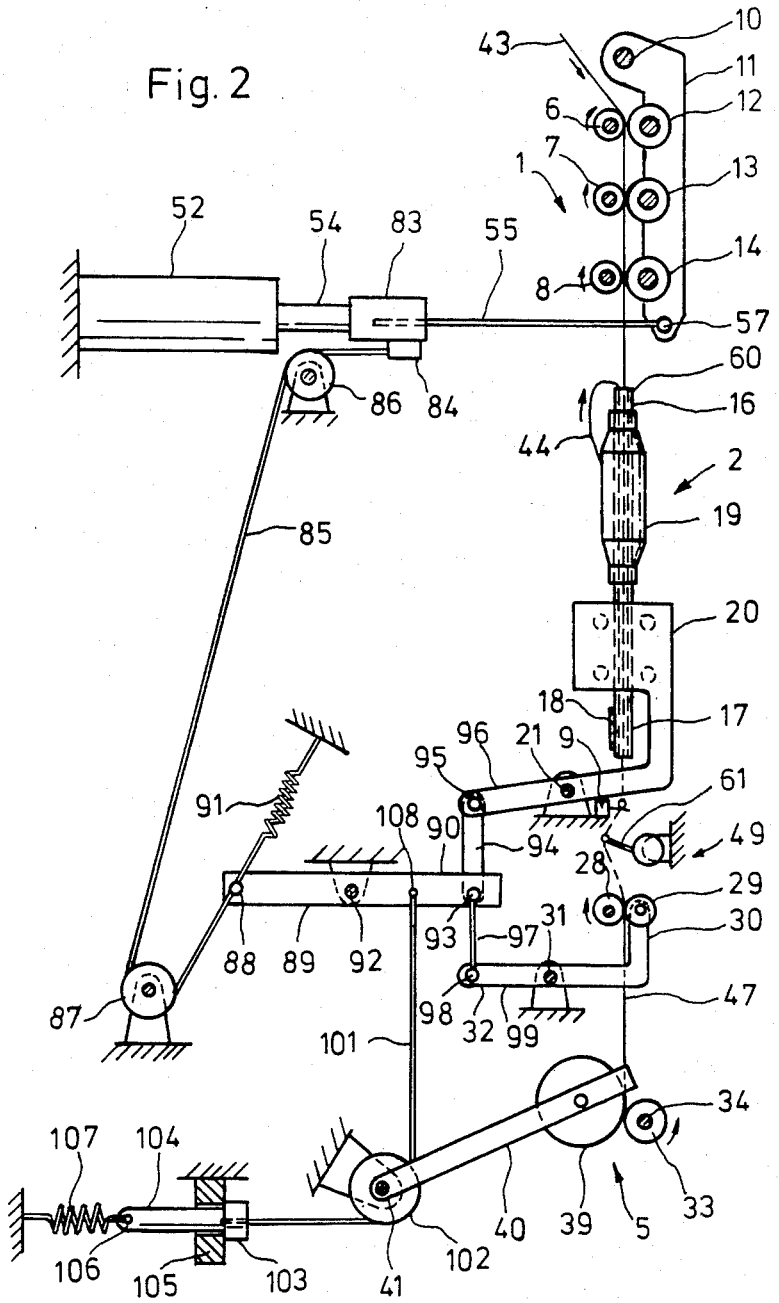
FIG. 2 is a somewhat schematic elevational view of an individual spinning place, similar to FIG. 1, and illustrating the various parts thereof shortly after a breakage of the binding yarn.
Figure 3:
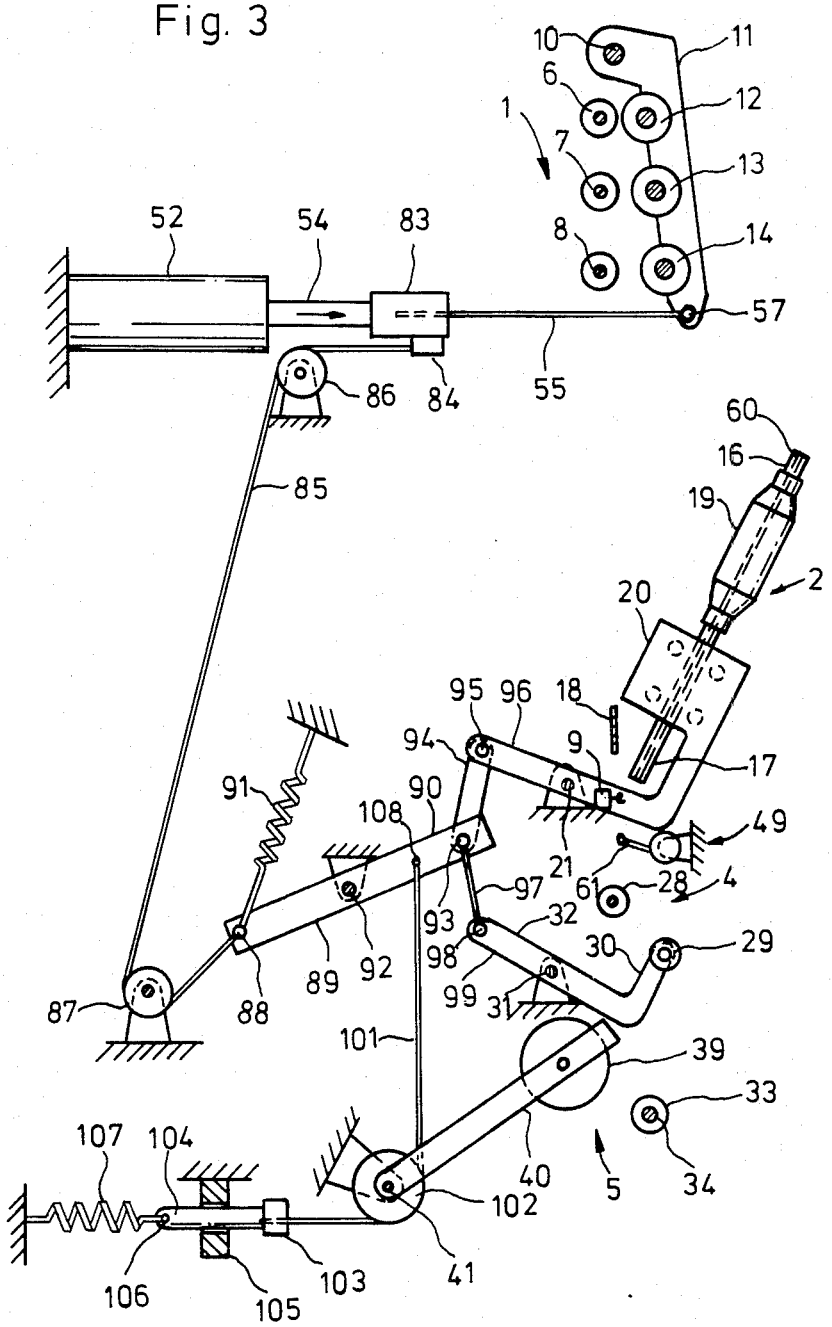
FIG. 3 is a somewhat schematic elevational view of an individual spinning place, similar to FIGS. 1 and 2, and illustrating the various parts thereof in the shut-off position initiated by a yarn detector and with interrupted drives.

Referring now to the drawing wherein like reference numerals are used throughout the various views to designate like parts, the spinning place of a wrapped yarn spinning machine according to FIGS. 1 to 3 includes, inter alia, a drafting unit generally designated by reference numeral 1 as feed or delivery device, a hollow spindle generally designated by reference numeral 2, a false twist device 60 mounted thereon, a pair of take-off rollers generally designated by reference numeral 4 as take-off device as well as a winding device generally designated by reference numeral 5. The drafting unit 1 includes three bottom rollers 6, 7 and 8 driven by and extending over the entire length of the machine, whereby the number of these rollers can differ depending on the application purpose. Upper rollers 12, 13 and 14 are coordinated to these bottom rollers 6, 7 and 8, which extend preferably only over one spinning place and are arranged in a weighting carrier 11 which is pivotal about a shaft 10 fixed in the machine. The pressure rollers 12, 13 and 14 are pressed preferably under spring pressure against the driven bottom rollers 6, 7 and 8. Provision is thereby made that the respectively succeeding roller pair rotates more rapidly than the preceding roller pair of the drafting unit 1. For example, the roller pair 7, 13 rotates more rapidly than the roller pair 6, 12 whereas the roller pair 8, 14 again rotates more rapidly than the roller pair 7, 13 so that the sliver 43 fed to the first roller pair 6, 12 in the direction of the arrow is drafted from roller pair to roller pair. A hollow spindle 2 is arranged downstream of the drafting unit 1. This hollow spindle 2 consists of a rotating spindle part 16 which is driven from the tangential belt 18 by way of a drive whirl 17. A binding thread spool 19 rotating in unison with the spindle 2 is nonrotatably mounted on the spindle 2. The spindle part 16 is rotatably supported in a bearing housing 20 which is pivotal about a shaft 21 fixedly arranged at the machine.

Figure 4:
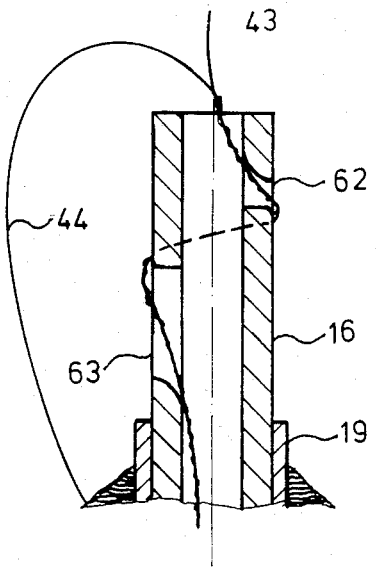
FIG. 4 is a vertical cross-sectional view, on an enlarged scale, through a hollow spindle with a false twist device in accordance with the present invention.
Figure 5:
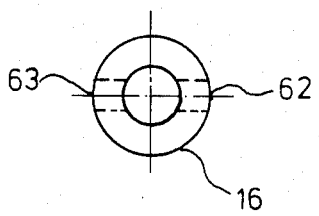
FIG. 5 is a top plan view on the hollow spindle of FIG. 4.

A false twist device 60 is mounted at the upper end of the hollow spindle 2 which forms a unitary structure together with the hollow spindle 2 (FIGS. 4 and 5). The false twist device 60 is so constructed in a simple but effective manner that two bores 62 and 63 extending in the radial direction (FIG. 4) are provided in the tubularly shaped spindle part 16 within the inlet area of the spindle part 16 facing the drafting unit 1. These bores 62 and 63 are disposed mutually displaced by about 180° —as viewed in axial direction—but are offset with respect to the spindle part 16 in the longitudinal direction thereof. The bore 63 has a larger diameter than the bore 62. It may also be constructed as elongated aperture whose greater length extends in the axial direction of the hollow spindle 2. Since for purposes of spinning start a finished (spun) yarn has to be introduced from the outlet of the hollow spindle through the bores 63 and 62 of the false twist device 60 and the inlet end of the hollow spindle 2, the lower area of the bore 63 and the upper area of the bore 62 are inclined toward the interior of the spindle part 16 for purposes of facilitated handling. The winding thread is also protected during the spinning operation by this measure.

The take-off roller pair 4 is arranged downstream of the hollow spindle 2, which includes a drive roller 28 extending over the entire machine length, to which is coordinated a pressure roller 29 extending only over a single spinning place. The pressure roller 29 rests against the drive roller 28 in the operating condition and can be pivoted in the clockwise direction away from the drive roller 28 about a fixed shaft 31 by way of a lever 30. The lever 30 is constructed as double-armed lever which includes an extension 32 to the rear of the shaft 31 adapted to be pivoted in unison therewith.

The winding device 5 is arranged downstream of the take-off roller pair 4 which includes a grooved roller 33 that serves for changing the winding yarn 47 to be wound. Each spinning location includes its own grooved roller 33 which is nonrotatably secured on a continuously driven shaft 34 extending over the entire machine. The winding spool 39 rests in the operating condition under spring pressure on the grooved roller 33; the winding spool 39 is thereby pivotal away from the grooved roller 33, for example, for the purpose of changing the spool, by means of a lever 40 which is pivotal about the shaft 41.

In the operating condition illustrated in FIG. 1, a sliver 43 is fed to the hollow spindle 2 by the drafting unit 1. After introduction into the interior of the hollow spindle 2, the sliver 43 is guided out of the interior of the hollow spindle 2 by way of the bore 62, as shown in FIG. 4, is placed about half the outer circumference of the hollow spindle 2 and then introduced again into the interior of the hollow spindle 2 through the bore 63 and guided downwardly through the spindle 2. As a result thereof, a false twist is imparted on the sliver 43 during the spinning operation, which continues or extends up to the drafting unit 1 and imparts to the sliver 43 a protective twist within this area and therewith an increased stability.

A binding thread 44 is guided from the feed spool 19 which is disposed on the hollow spindle 2 and rotates in unison therewith, together with the sliver 43 through the hollow spindle 2; the binding thread 44 thereby winds about the sliver 43 as a result of the rotation of the hollow spindle 2 and binds or ties up the sliver 43 with spiral convolutions. Since the binding thread 44 together with the sliver 43 is guided through the false twist device 60, the formation consisting of the sliver 43 and of the binding thread 44 also receives a false twist, which again opens up nearly completely during the travel to the take-off rollers 28 and 29.

The false twist is no longer needed for the stabilization of the sliver after the sliver 43 is wrapped by the binding thread 44, so that the opening up of the false twist within the area between the false twist device 60 and the take-off rollers 28 and 29 is harmless. The formation consisting of the sliver 43 and of the binding thread 44, after leaving the hollow spindle 2 is taken off by the pair 4 of take-off rollers as finished wrapped yarn 47 and is fed to the winding device 5.

Figure 6:
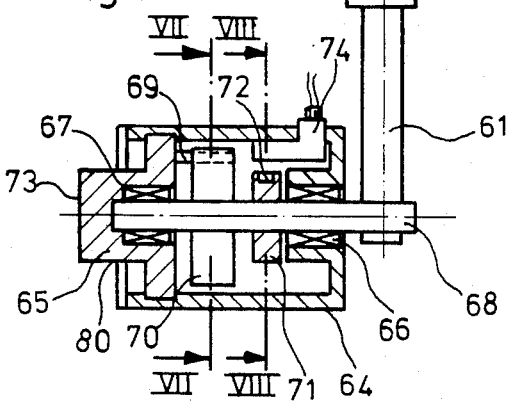
FIG. 6 is an axial cross-sectional view through one embodiment of a yarn detector in accordance with the present invention illustrated in the spinning aggregate according to FIGS. 1 to 3.
Figure 7:
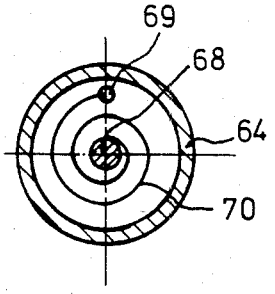
FIG. 7 is a cross-sectional view taken along line VII—VII of FIG. 6.
Figure 8:
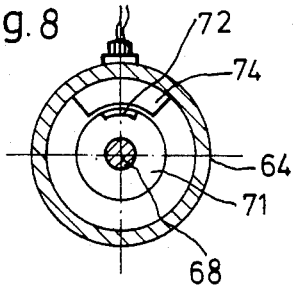
FIG. 8 is a cross-sectional view, taken along line VIII—VIII of FIG. 6.

A yarn feeler or detector generally designated by reference numeral 49 is arranged downstream of the hollow spindle 2 in the direction of movement of the yarn, which monitors the tension of the finished wrapped yarn 47 whereby already a tension decrease by the breakage of only one component is detected and evaluated (FIGS. 6, 7 and 8). The yarn detector 49 consists of a feeler arm 61 and, for example, of a cylindrical housing 64 which is secured at the machine frame and contains the remaining parts of the yarn detector 49. A shaft 68 is rotatably arranged in the longitudinal direction of the housing 64 within bearings 66 and 67; the feeler arm 61 is nonrotatably mounted on the end of the shaft 68 extending outside of the housing 64, whereby the feeler arm 61 can be rotated together with the shaft 68 between abutments (not shown). The bearing 67 is accommodated within an adjusting wheel 65 which is rotatably supported in the housing 64 and is provided with detents (not shown). The part of the adjusting wheel 65 projecting out of the housing 64 includes at the end face thereof an adjusting scale 73 coordinated to a housing marking and is knurled at its cylindrical surface 80. The adjusting wheel 65 is connected by way of the connecting rod 69 with the outer end of a spirally wound spring 70 which is secured with its inner end at the shaft 68 (FIG. 7). By rotation of the adjusting wheel 65, the force of the feeler arm 61 can be adjusted, with which the feeler arm rests against the wrapped yarn 47 so that an adaptation to the yarn tension is possible.

Figure 10:
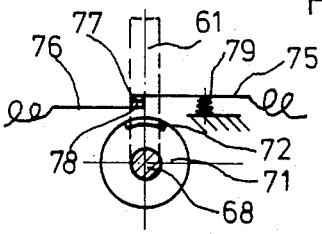
FIGS. 9 and 10 are partial somewhat schematic elevational views illustrating the electric switching device of the yarn detector according to FIGS. 6 to 8.
Figure 9:
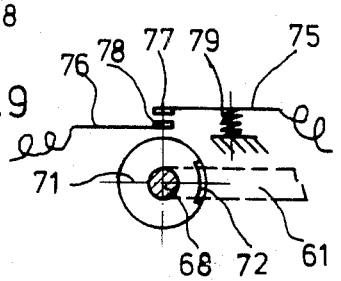

A disk 71 is nonrotatably mounted on the shaft 68 which is provided with a permanent magnet 72 over a partial area of its circumference (FIG. 8). A switching element 74 is mounted at a slight distance from the circumference of the disk 70 which essentially consists of a relay (FIGS. 9 and 10). The relay includes two small elongated, elastically flexible or bendable metal plates 75 and 76 which are connected with the shut-off device of the spinning aggregate by way of electric cables and which carry at their ends the contacts 77 and 78. The contact 77 of the small flexible metal plate 75 is held in the operating condition at a distance from the contact 78 of the small metal plate 6 (FIG. 9). The permanent magnet 72 is disposed, corresponding to the position of the feeler arm 61 indicated in dash line, at a sufficiently large distance from the contacts 77 and 78 so that in this position a magnet action is not exerted on the metal plate 75.

During the spinning operation the feeler arm 61 abuts against the moving wrapped yarn 47. The spring 70 is so adjusted that the individual tension of the sliver 43 and of the binding thread 44 is, in each case, smaller than the force of the spring 70 which is transmitted by the feeler arm 61. The finished wrapped yarn 47 has a sufficient strength so that the force of the spring 70 is not sufficient in order to deflect the feeler arm 61 into the switching position (FIG. 1).

In case of disappearance of a yarn component, for example, as a result of breakage or interruption of the fed sliver 43 or after the binding thread spool 19 becomes empty, the strength and therewith the tension of the still-remaining components drops below the force exerted by the feeler arm 61 so that the latter rotates corresponding to the force of the spring 70—illustrated in an exaggerated manner in FIG. 2—and deflects the nonspun yarn components fed from the hollow spindle 2.

The tension decrease, in case of a breakage of the winding thread 44, can be traced back to the fact that the sliver 43 alone still possesses only a slight cohesiveness within the area below the hollow spindle 2. Since the individual staple fibers are not simultaneously clamped fast by the drafting unit 1 and the take-off roller pair 4 and since the false twist imparted by the false twist device 60 arranged at a relatively great distance has opened up substantially, the yarn detector 49 can readily deflect the supplied sliver 43 by reason of the adjusted spring force. In case of interruption of the sliver supply, the yarn detector 49 acts against the tension produced by the yarn balloon of the binding thread 44 so that also in this case the feeler arm 61 rotates with a corresponding adjustment and deflects the binding thread 44 below the hollow spindle 2. In order that the yarn detector 49 does not deflect the wrapped yarn 47 (or in case of a disturbance only one of the components) so far that it drags at the lower outlet of the hollow spindle 2, an eyelet 9 is arranged below the hollow spindle 2 for limiting the deflection which is preferably arranged coaxially to the hollow spindle 2 and has a smaller inner diameter than the latter.

The disk 71 rigidly connected with the shaft 68 is also rotated with the deflection of the feeler arm 61 so that the permanent magnet 72 reaches the area of the relay of the switching part (FIG. 10). As a result of the action of the permanent magnet 72, the contact 77 of the small metal plate 75 is connected with the contact 78 of the small metal plate 76 against the force of the spring 79. As a result thereof, a control circuit is closed which initiates the shut-down of the spinning place.

The shut-down triggered by the yarn detector 49 takes place by a pivotal movement of the individual devices out of engagement with their drives. For that purpose, a pneumatic cylinder 52 is provided which is connected with the deflection devices by way of actuating means (FIGS. 1 to 3). The pneumatic cylinder 52 is rigidly secured at the machine frame in a conventional manner, not illustrated in detail. The piston 54 of the actuating cylinder 52 is provided with a clamping element 83, into which is clamped a leaf spring 55 extending in extension of the piston 54; the free end of the leaf spring 55 is pivotally connected to the free end of the weighting carrier 11 of the drafting unit 1 in a point of pivotal connection 57.

The leaf spring 55, which is retained at the point of pivotal connection 57, laterally adjacent the pressure roller 14, is constructed sufficiently rigidly in order to be able to transmit the force required for the lifting off of the weighting carrier 11 in its longitudinal direction. The leaf spring 55 is flexible transversely thereto in such a manner that it can compensate for the difference between the linear movement of the piston 54 and the arcuate movement of the point of pivotal connection 57.

A retaining element 84 for a draw element 85 is mounted on the piston 54, respectively, on the clamping member 83. The draw element 85 extends by way of a first stationary deflecting roller 86 disposed within the area of the actuating cylinder 52 in the downward direction and then over a further stationary deflecting roller 87 back upwardly. It is then pivotally connected at a point of pivotal connection 88 with a two-armed intermediate lever 89, 90 which is pivotal about a fixed shaft 92. A spring 91 tensioning the draw element 85 engages at the intermediate lever 89, which is constructed as a drawspring and engages at the point of pivotal connection 88.

A link 94 engages at the second arm 90 of the intermediate lever 89, 90 in a point of pivotal connection 93; the link 94 is connected to a second two-armed lever 96 by means of a point of pivotal connection 95; the two-armed lever 96, in turn, is pivotally supported about a shaft 21 parallel to the shaft 92. This lever 96 which is also of double-armed construction, carries the bearing housing 20 of the hollow spindle 2 by means of its oppositely disposed lever arm.

A further link 97 is arranged at the same point of pivotal connection 93 of the intermediate lever 89, 90 on the side opposite the link 94, which link 97 is constructed, for example, as leaf spring and is pivotally connected to an arm 32 of a lever 99 in a point of pivotal connection 98; the lever 99 is pivotal about a shaft 31 parallel to the shafts 21 and 92 and carries with its other arm 30 the nondriven take-off roller 29. The two levers 96 and 99 are thus pivotally connected at the intermediate lever 89, 90 in such a manner that they move in the same direction in case of a displacement of the intermediate lever 89, 90.

A further draw element 101 (draw cable or band) is pivotally connected at the arm 90 of the intermediate lever 89, 90 which is spring-loaded by means of a spring 107 engaging at the machine frame. The draw element 101 is placed about a disk or pulley 102 which is nonrotatably connected with the spool support 40 of the spool 39 and is arranged coaxially to the pivot shaft 41 thereof. A bolt 104 is provided between the tensioning spring 107 and the draw cable 101, which is guided in a slide guidance 105 and whose end is provided with a means 106 for hooking-in the tension spring 107. The bolt 104 is provided on the side of the slide guidance 105 opposite the tension spring 107 with a thickened head or annular collar 103 which limits the movement of the bolt 104 and therewith also of the draw element 101. The position of the slide guidance 105 and of the head 103 is so selected that in the operating position (FIG. 1) the head 103 abuts at the slide guidance 105 in such a manner that the draw element 101 is placed only loosely about the pulley 102 so that no force is transmitted from the draw element 101 to the disk or pulley 102. The spool holder 40 which is spring-loaded in a conventional manner in the direction toward the winding roller 33 by means of a loading spring (not shown), is thus freely movable in the operating position so that it can adapt its position to the respective diameter of the spool 39.

In order to shut-down the spinning aggregate, the piston 54 of the actuating cylinder 52 is extended by subjecting the piston 54 to a corresponding load with the pressure medium (FIG. 3) so that it lifts off by way of the leaf spring 55 the weighting carrier 11 from the bottom rollers 6, 7, and 8 which are constructed as cylinders extending uninterruptedly over the length of the machine. Simultaneously therewith, the piston 54 thereby pivots the lever 96 by way of the draw element 85 and the lever mechanism so that the spindle 2 is lifted off from the tangential belt 18.

Furthermore, the lever 99 is pivoted in such a manner that the non-driven take-off roller 29 is lifted off from the take-off roller 28 constructed as cylinder also extending over the length of the machine. Additionally, the spool holder 40 is pivoted by way of the draw element 101 so that the spool 39 is lifted off from the winding roller 33. As soon as the intermediate lever 89 is pivoted in the direction of the inoperative position, the draw element 101 is tensioned by means of the tensioning force of the drawspring 107 and abuts tensioned against the disk or pulley 102. The friction resulting by reason of the loop angle (in the illustrated embodiment, 90°) between the pulley 102 and the draw element 101 effect an entrainment force, by means of which the spool holder 40 is pivoted together with the spool 39. The pivoting of the spool holder 40 is thereby completely independent from the respective position of the spool holder 40, which is dependent on the diameter of the spool 39. Draw cables, draw bands or the like may be used as draw elements 85 and 101.

During the reestablishing of the operating position, the piston 54 of the actuating cylinder 52, starting from the position according to FIG. 3, is again retracted so that it again moves the weighting carrier 11 together with the upper rollers 12, 13 and 14 elastically springily retained thereat, into their operating position vis-a-vis the bottom rollers 6, 7 and 8. The operating position of the drafting unit 1 is then secured again by the actuating cylinder 52. The drawspring 91 causes the intermediate lever 89 to reassume its operating position (FIG. 1), as a result of which the hollow spindle 2 is brought into engagement with the tangential belt 18 and the non-driven take-off roller 29 is brought into engagement with the driven take-off roller 28 as well as the spool 39 with the winding roller 33. The latter takes place by reason of the entrainment force of the tensioning spring 107 and more particularly so far until the head portion 103 abuts at the guidance 105.

It has proved advantageous for a start spinning operation after an operating interruption, if the engagement of the drive of the hollow spindle 2 and the closing of the take-off rollers 28 and 29 as well as the abutment of the spool 39 at the winding roller 33 is delayed timewise relative to the closing of the drafting unit 1. For that purpose, an independently controllable, movable abutment is appropriately provided which enables a return of the spindle 2, of the take-off roller 29 and of the spool holder 40 into the operating position with a time-delay. For example, a mechanical locking element may be provided which is actuated by the operating person and which locks the inoperative position of one of the levers 89, 96 or 99 at any place. Of course, also a pneumatically or electrically controlled locking element in the form of an adjusting magnet or of an actuating cylinder may be provided.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A wrapped yarn spinning machine having several spinning places, each spinning place comprising a drive means for rotatably driving a hollow spindle means, a hollow spindle means operatively connected with the drive means and having an inlet end, a binding thread rotating in unison with and carried by said hollow spindle means, a delivery means for at least one sliver to be wrapped by spinning and a take-off means for the wrapped yarn, the hollow spindle means being arranged between the delivery means and the take-off means, false twist means associated with the hollow spindle means, and yarn detecting means for detecting the yarn tension and operable to individually shut down a respective spinning place by interruption of the sliver feed and of the drive means of the hollow spindle means in case of breakage of the binding thread and/or the sliver, the false twist means associated with the hollow spindle means of each spinning place being arranged at the inlet end of the hollow spindle means and being operable to impart a false twist into the sliver for each rotation of the respective hollow spindle means, and the yarn detector means associated with each spinning place being arranged between the hollow spindle means and the take-off means.

2. A wrapped yarn spinning machine according to claim 1, further comprising means for limiting deflection of wrapped yarn by the yarn detector means, which being arranged between the hollow spindle means and the yarn detector means.

3. A wrapped yarn spinning machine according to claim 1 or 2, wherein the yarn detector means includes a spring-loaded feeler means having a spring and operable to engage with the wrapped yarn, and adjusting means for adjusting the tension of said spring which spring-loads said feeler means.

4. A wrapped yarn spinning machine according to claim 3, wherein the spring of said yarn detector means is a spiral spring which with its one end is operatively connected with the feeler means and with its other end with said adjusting means.

5. A wrapped yarn spinning machine according to claim 4, further comprising an adjusting scale coordinated to the adjusting means.

6. A wrapped yarn spinning machine according to claim 4, wherein the distance between the false twist means and the take-off roller means corresponds at least to twice the staple length of the sliver to be wrapped by spinning.

7. A wrapped yarn spinning machine according to claim 6, further comprising an adjusting scale coordinated to the adjusting means.

8. A wrapped yarn spinning machine according to claim 1 or 2, wherein the distance between the false twist means and the take-off roller means corresponds at least to twice the staple length of the sliver to be wrapped by spinning.

9. A wrapped yarn spinning machine according to claim 8, wherein the yarn detector means includes a spring-loaded feeler means having a spring and operable to engage with the wrapped yarn, and adjusting means for adjusting the tension of the spring which spring-loads said feeler means.

10. A wrapped yarn spinning machine having several spinning assemblies, each of the several spinning assemblies comprising: hollow spindle means having an inlet end, driving means for rotatably driving said hollow spindle means, a drawing unit for drawing sliver arranged upstream of the hollow spindle means, drawing unit driving means for delivering the sliver to the hollow spindle means, a binding thread bobbin provided on said hollow spindle means and rotating in unison therewith and having a supply of binding thread thereon for binding the sliver passing through the hollow spindle means, a pair of take-off rolls and a yarn wind-up device downstream of said hollow spindle means for taking off and winding-up the wrapped yarn being formed, driving means for said device for taking off and winding-up the wrapped yarn, false twist means arranged at the inlet end of said hollow spindle means operably imparting a false twist into the sliver for each rotation of the respective hollow spindle means, yarn detecting means arranged between said hollow spindle means and said take-off rolls for detecting the yarn tension and operable to individually shut down a respective spinning assembly by interruption of at least the drawing unit driving means in case of breakage of the binding thread and/or the sliver, the distance between the false twist means and the take-off rolls corresponding at least to twice the staple length of the sliver to be wrapped by spinning, the yarn detecting means including a spring-loaded feeler means operable to engage with the wrapped yarn, a spring which spring-loads the feeler means, and adjusting means for adjusting the tension of said spring.

11. A wrapped yarn spinning machine according to claim 1, wherein the false twist means includes a substantially tubular member having a plurality of openings therein through which the sliver and the binding are threadedly entrained.

12. A wrapped yarn spinning machine according to claim 10, wherein the false twist means includes a substantially tubular member having a plurality of openings therein through which the sliver and the binding are threadedly entrained.

* * * * *